US009003625B2

(12) United States Patent
Ferril et al.

(10) Patent No.: US 9,003,625 B2
(45) Date of Patent: Apr. 14, 2015

(54) SHREDDER FEEDER

(71) Applicant: Identisys, Inc., Eden Prairie, MN (US)

(72) Inventors: Debra R. Ferril, Excelsior, MN (US); David Roman, Westminster, CO (US)

(73) Assignee: Identisys, Inc., Eden Prairie, MN (US)

( * ) Notice: Subject to any disclaimer, the term of this patent is extended or adjusted under 35 U.S.C. 154(b) by 215 days.

(21) Appl. No.: 13/706,953

(22) Filed: Dec. 6, 2012

(65) Prior Publication Data

US 2014/0157566 A1 Jun. 12, 2014

Related U.S. Application Data

(62) Division of application No. 12/640,147, filed on Dec. 17, 2009, now Pat. No. 8,348,185.

(51) Int. Cl.
*B02C 25/00* (2006.01)
*B02C 18/22* (2006.01)

(52) U.S. Cl.
CPC ..... *B02C 18/2283* (2013.01)

(58) Field of Classification Search
USPC ..... 29/428, 462, 464; 241/30, 222, 224, 241/225, 300
See application file for complete search history.

(56) References Cited

U.S. PATENT DOCUMENTS

| | | | | |
|---|---|---|---|---|
| 4,986,481 | A | 1/1991 | Fujii et al. | |
| 5,205,495 | A | 4/1993 | Garnier | |
| 5,375,780 | A | 12/1994 | Gray et al. | |
| 5,562,255 | A | 10/1996 | Witko et al. | |
| 5,934,580 | A | 8/1999 | Maier et al. | |
| 6,595,216 | B1 | 7/2003 | Wessinger | |
| 7,546,965 | B1 | 6/2009 | Parkin | |
| 7,854,405 | B2 | 12/2010 | Adachi et al. | |
| 7,973,959 | B2 | 7/2011 | Chihara | |
| 8,146,845 | B2 | 4/2012 | Chen | |
| 8,348,185 | B2 * | 1/2013 | Ferril et al. | 241/30 |
| 2002/0070300 | A1 * | 6/2002 | McLean et al. | 241/30 |
| 2008/0210794 | A1 | 9/2008 | Schwelling et al. | |

(Continued)

FOREIGN PATENT DOCUMENTS

| | | |
|---|---|---|
| DE | 1528698 | 10/1978 |
| JP | 2004091162 | 3/2004 |

(Continued)

OTHER PUBLICATIONS

RL Ribbon Shredder, DigiOn24, ID Card Ribbon Shredder (2 sheets) http://www.digion24.com/pdf/application/DigiOn24_RL6.pdf.

*Primary Examiner* — Christopher Besler
(74) *Attorney, Agent, or Firm* — Dicke Billing & Czaja, PLLC

(57) ABSTRACT

A shredder feeder has a first receiving post configured to receive a roll of first material, second and third receiving posts respectively configured to receive first and second rolls of second material, and a pair of guideposts that form an outlet of the shredder feeder therebetween. The respective guideposts are positioned to respectively direct the second material from the first and second rolls toward the first material from the roll of first material so that the first material is interposed between the second material from the first roll of second material and the second material from the second roll of second material when the first material and the second materials from the first and second rolls of second material pass concurrently through the outlet.

6 Claims, 7 Drawing Sheets

(56) References Cited

U.S. PATENT DOCUMENTS

| | | | | |
|---|---|---|---|---|
| 2011/0147503 | A1* | 6/2011 | Ferril et al. | 241/30 |
| 2013/0175025 | A1 | 7/2013 | Vick, Jr. et al. | |
| 2013/0206389 | A1 | 8/2013 | Vick, Jr. et al. | |

FOREIGN PATENT DOCUMENTS

| | | |
|---|---|---|
| JP | 2005021728 | 1/2005 |
| WO | 2013089730 | 6/2013 |
| WO | 2013089746 | 6/2013 |

* cited by examiner

SHREDDER FEEDER

RELATED APPLICATION

This application is a divisional of U.S. application Ser. No. 12/640,147, titled "SHREDDER FEEDER," filed Dec. 17, 2009 (allowed), which application is commonly assigned and incorporated entirely herein by reference.

FIELD

The present disclosure relates generally to shredders and in particular the present disclosure relates to shredder feeders.

BACKGROUND

Transfer ribbon, such as thermal printing ribbon, dry diffusion thermal transfer ribbon, topping ribbon, indent ribbon, etc., typically includes a transferable marking material that can be transferred to a surface, e.g., to form images on the surface, by pressing the transfer ribbon between the surface and a pressing element that may or may not be heated.

Transfer ribbon is sometimes used to form images, such as images containing identity information, on cards, such as transaction cards. However, an imprint, e.g., a negative image, of the identity information remains on the transfer ribbon. Credit and debit cards, library cards, etc. are examples of transaction cards that may include identity information. Identity information, such as a user name, account number, expiration date, etc., may be confidential and it is desirable to keep this information from would be identity thieves.

Used transfer ribbon containing identity information that may be confidential should be destroyed. However, there is no simple method of destroying the used transfer ribbon. For example, in large production environments, used transfer ribbon may be collected for destruction through an outside service. However, equipment that uses transfer ribbon to form images of transaction cards, such as card printers and embossers, are not always in a large production environment, and it may be too costly and/or impractical to use an outside service. As a result, used transfer ribbon is sometimes thrown in the trash and is susceptible to theft.

For the reasons stated above, and for other reasons stated below which will become apparent to those skilled in the art upon reading and understanding the present specification, there is a need in the art for alternative methods for disposing of or destroying material, such as used transfer ribbon.

SUMMARY

Embodiments herein disclose shredder feeders. For example, a shredder feeder has a first receiving post configured to receive a roll of first material, second and third receiving posts respectively configured to receive first and second rolls of second material, and a pair of guideposts that form an outlet of the shredder feeder therebetween. The respective guideposts are positioned to respectively direct the second material from the first and second rolls toward the first material from the roll of first material so that the first material is interposed between the second material from the first roll of second material and the second material from the second roll of second material when the first material and the second materials from the first and second rolls of second material pass concurrently through the outlet.

DETAILED DESCRIPTION

Figure 1:
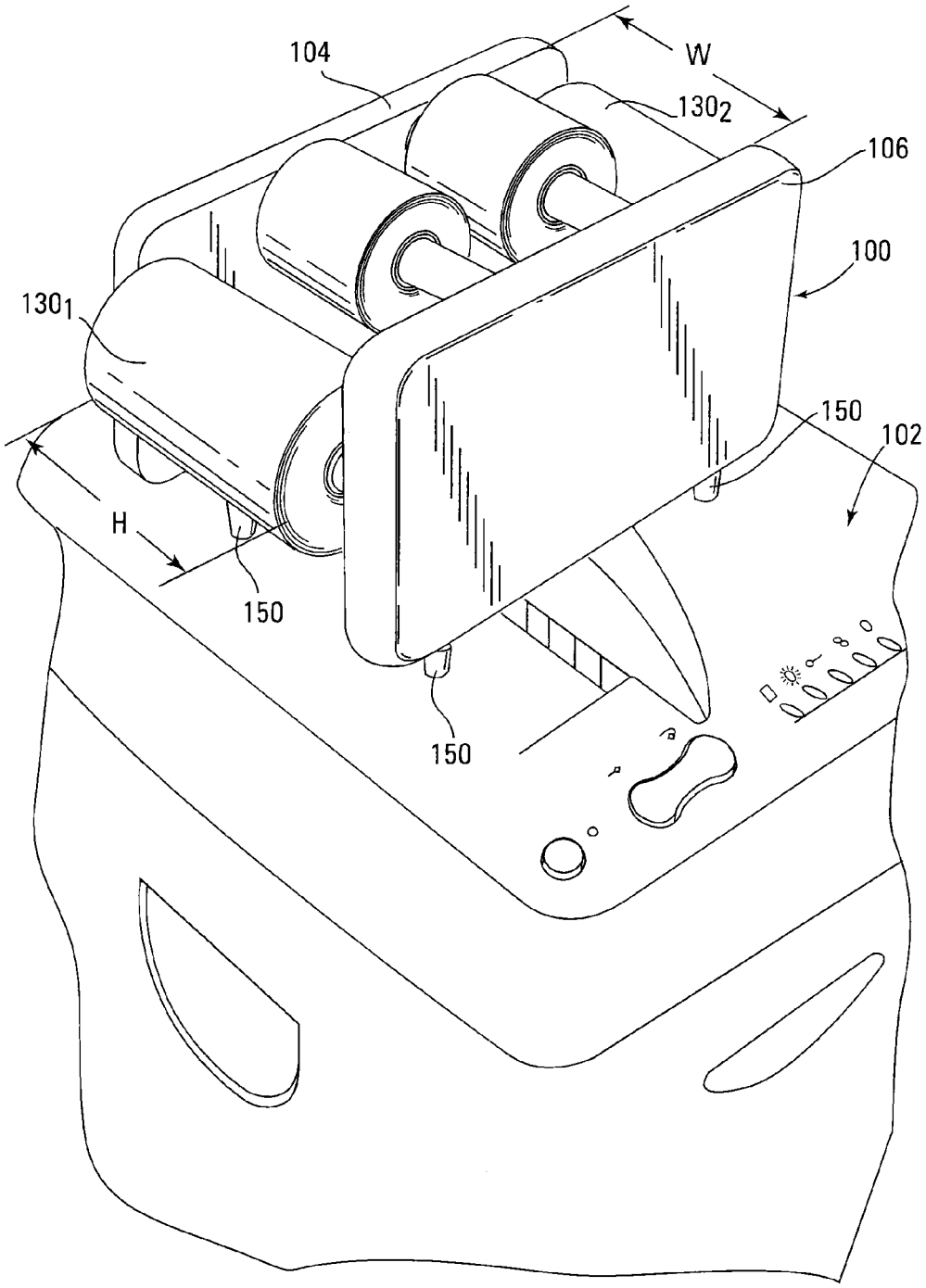
FIG. 1 illustrates a shredder feeder mounted in an operative position on a shredder, according to an embodiment.

In the following detailed description, reference is made to the accompanying drawings that form a part hereof, and in which is shown, by way of illustration, specific embodiments. In the drawings, like numerals describe substantially similar components throughout the several views. Other embodiments may be utilized and structural changes may be made without departing from the scope of the present disclosure. The following detailed description is, therefore, not to be taken in a limiting sense, and the scope of the present disclosure is defined only by the appended claims and equivalents thereof.

The example embodiments herein use shedders, such as standard office shredders or home shredders, to destroy a material, such used transfer ribbon. However, shedders are typically designed to shred paper, plastic cards, etc. and not transfer ribbon that is thinner, more flexible, and of lighter weight than most paper and plastic cards. For example, it may be difficult to insert transfer ribbon into the inlet of some shredders, in that the transfer ribbon can flex and buckle. This is especially problematic for shredders that are activated upon insertion of media into the inlet, in that the transfer ribbon might not be capable of being sufficiently inserted to activate the shredder.

Owing to its light weight and thinness (e.g., about 0.001 in.), when transfer ribbon is drawn into a shredder, it can become lodged in the shredder's strippers, (e.g., devices used in some shredders to cause paper to be expelled from the cutting cylinders). Shredders are typically designed to shred paper sheets that are considerably thicker (e.g., about 0.004 in.) than most transfer ribbon, meaning that the strippers are designed for this greater thickness. Consequently, transfer ribbon can become jammed in the strippers, eventually causing the shredder to sieze. This problem may be further aggravated by the fact that some transfer ribbons may have a static charge that can cause them stick to the cutting cylinders of a shredder.

Shredders are usually activated by a light sensor that detects when a medium, such as paper, is inserted by sensing when a beam of light is interrupted by the medium and is not received by the sensor. However, some transfer ribbons are translucent enough to pass enough light therethrough so that the sensor continues to receive the light or receives light intermittently, and thus the sensor either fails to activate the shredder at all or fails to keep the shredder activated.

In order to overcome the above mentioned problems with using shredders to shred used transfer ribbon and other problems associated with shredders, embodiments of the present disclosure provide a shredder feeder that can be used to feed material, such as used transfer ribbon or lightweight paper, into a shredder.

Figure 2:
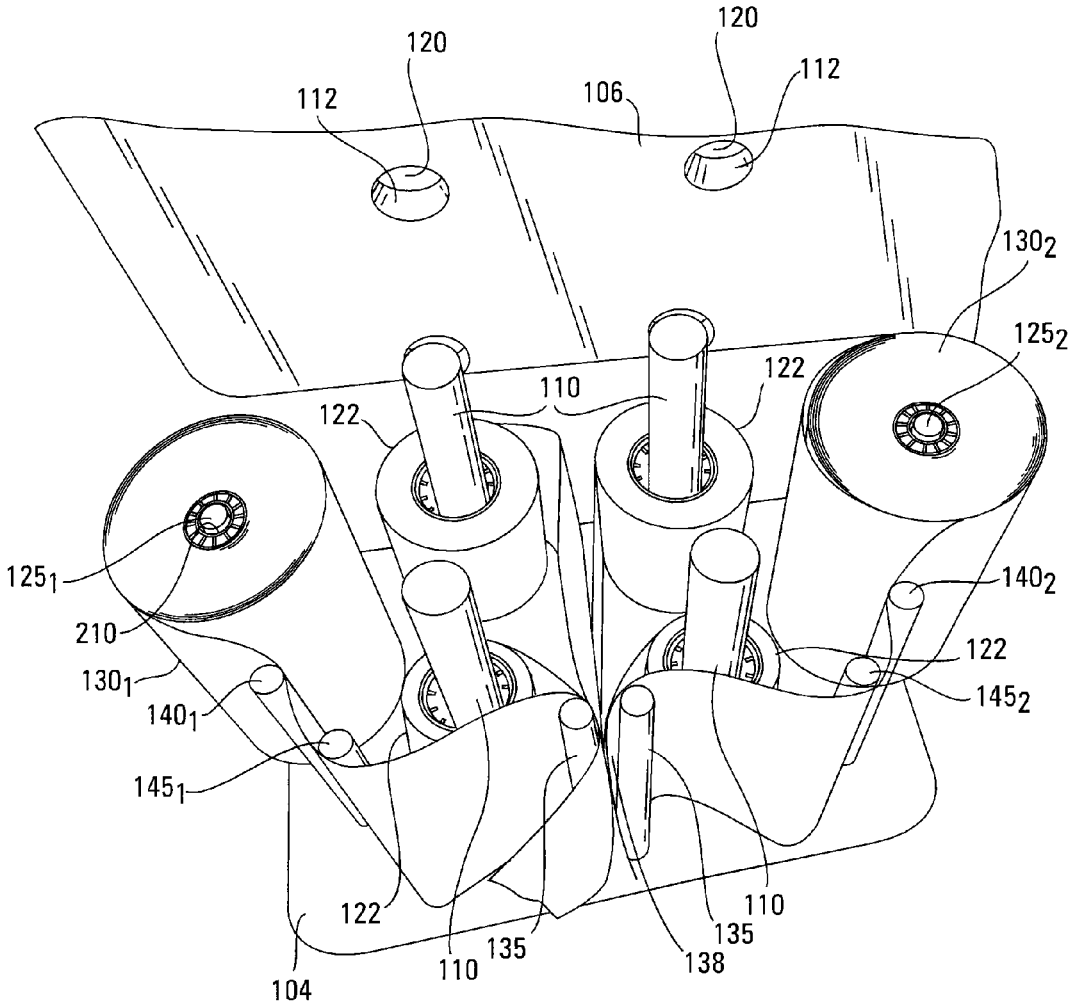
FIG. 2 illustrates an interior of a shredder feeder loaded with rolls of material, according to another embodiment.

FIG. 1 illustrates a shredder feeder 100, such as a ribbon feeder, positioned in an operative position on a shredder 102. Shredder 102 may be a standard office shedder or may be of the type commonly intended for home use. Shredder feeder 100 includes a pair of opposing walls (e.g., sidewalls 104 and 106) that may be of plastic, metal, e.g., aluminum, wood, etc. As shown in FIG. 2, one of the sidewalls, e.g., sidewall 106, is removably connected (e.g., attached) to ends of one or more (e.g., four in FIG. 2) posts 110 (e.g., that may be called pillars, shafts, dowels, etc.). Ends of posts 110 (opposite to the ends removably connected sidewall 106) may be connected (e.g., attached) to sidewall 104, e.g., by fasteners, such as screws 710 (FIG. 7), by gluing, by welding, etc., so that posts 110 are stationary. For some embodiments, posts 110 may be cylinders, as shown in FIG. 2.

Note that FIG. 2 illustrates shredder feeder 100 with sidewall 106 removed. Removal of sidewall 106 provides access to the interior of shredder feeder 100.

Figure 3:
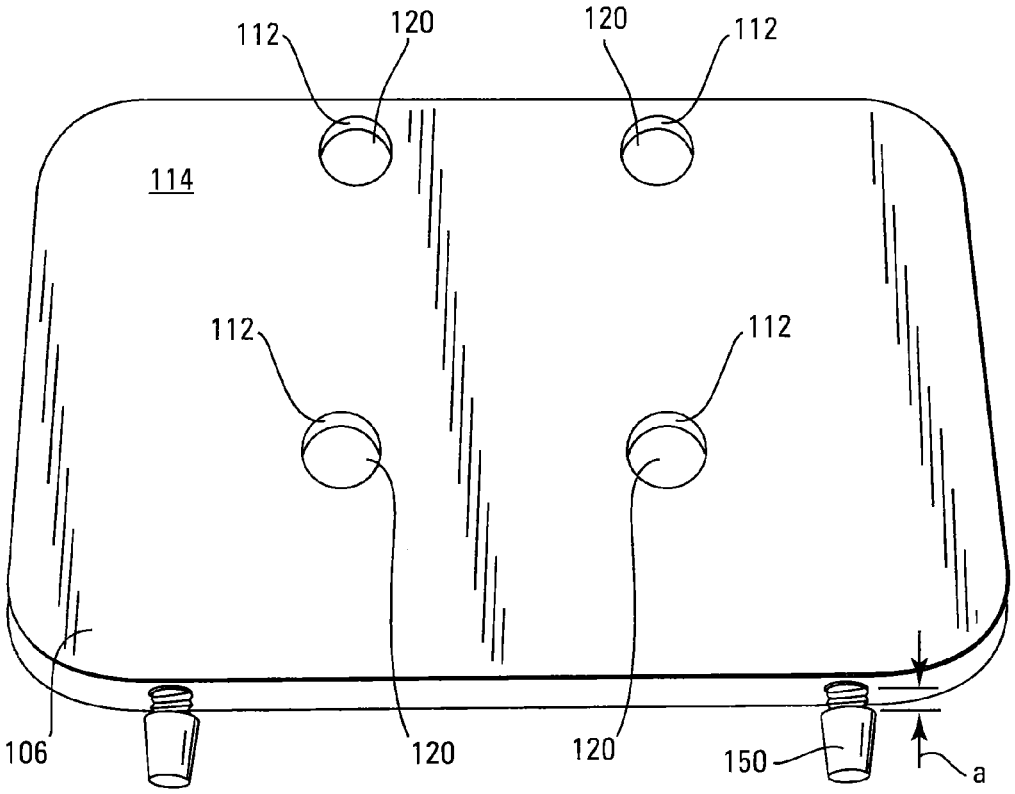
FIG. 3 illustrates an interior surface of a removable wall of a shredder feeder, according to another embodiment.
Figure 7:
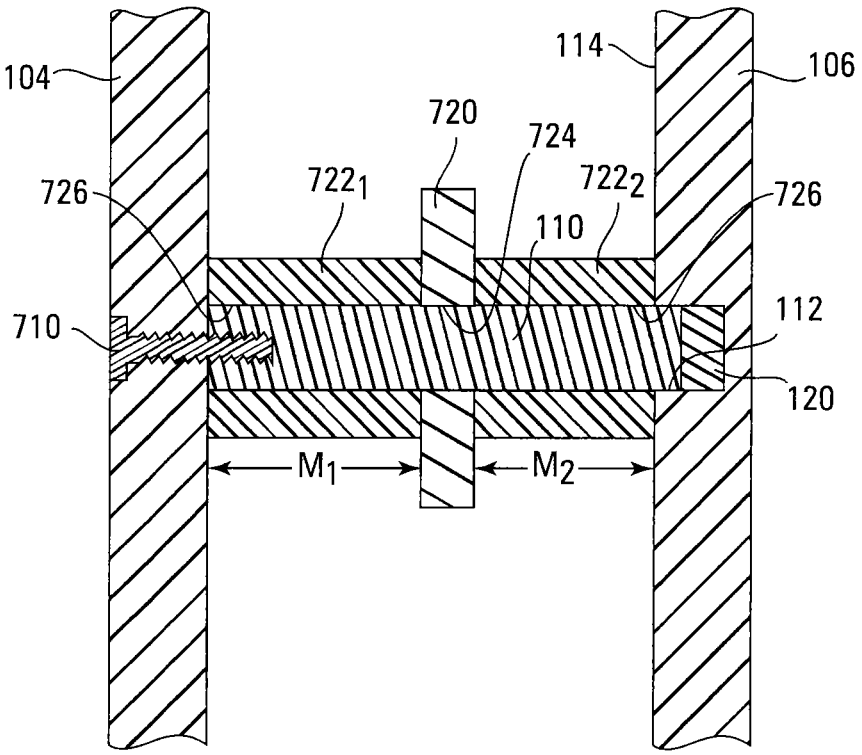
FIG. 7 is a cross-sectional view of a post of a shredder feeder with spacers, according to another embodiment.

FIG. 3 illustrates sidewall 106. Recesses 112 (e.g., blind holes) may be formed in an interior surface 114 of sidewall 106, as shown in FIGS. 2, 3, and 7. Posts 110 correspond to recesses 112 on a one-to-one basis and are respectively received in the corresponding ones of recesses 112.

A magnet 120 (FIGS. 2, 3, and 7), such as a neodymium magnet, may be secured within each recess 112, e.g., at the bottom of each recess 112, and each of the posts 110 may be made of a magnetic material, such as steel, iron, etc., so that magnets 120 can removably magnetically connect (e.g., attach) sidewall 106 to the ends of posts 110 by exerting an attractive magnetic force on posts 110. Alternatively, posts 110 may be made of a non-magnetic material, such as aluminum, wood, plastic, etc., and have a layer (e.g., a disc) of magnetic material in the form of a cap affixed to their end surfaces for connecting to magnets 120.

Each of posts 110 is configured to receive a roll 122 of material, as shown in FIG. 2, so that each roll 122 can rotate about its respective post 110. As such, posts 110 may be referred to as receiving posts. The material of roll 122 may be ribbon, such as used transfer ribbon, lightweight paper that is too light to be easily fed into a shredder, etc. Non-limiting examples of transfer ribbon include thermal printing ribbon, dry diffusion thermal transfer ribbon, topping ribbon, indent ribbon, etc.

Thermal transfer ribbon typically includes a transferable marking material, such as a pigmented wax or resin compound, deposited on one side. The thermal transfer ribbon is interposed between a surface of a card and an element. The transferable marking material is transferred to the card by heating areas of the thermal transfer ribbon with the element, thereby forming an image, e.g., of identity information, on the card.

Topping ribbon (e.g., sometimes called topping foil) is typically used to top images embossed on cards with color. For example, topping ribbon may include a coating of colored transferable marking material, e.g., of plastic. When the topping ribbon is pressed between an image embossed on a card and a heated pressing element, the heated element causes the colored marking material to be transferred from the topping ribbon to the embossed image.

Indent ribbon is used with indent printing and is coated with a colored transferable marking material. The indent ribbon is pressed between an element and a card so that the element presses the ribbon into the surface of the card to create identity information from indented characters in the card surface. The colored transferable marking material is transferred from the ribbon into the indented characters. Indent ribbon is sometimes used to form a single line of characters, and its width may be about the height of the single line of characters. As such, the width of indent ribbon may be much less than the width of conventional transfer ribbon, such as thermal transfer and topping ribbon. As such, spacers may be used to space the indent ribbon from sidewalls 104 and 106, as further described below.

Figure 4:
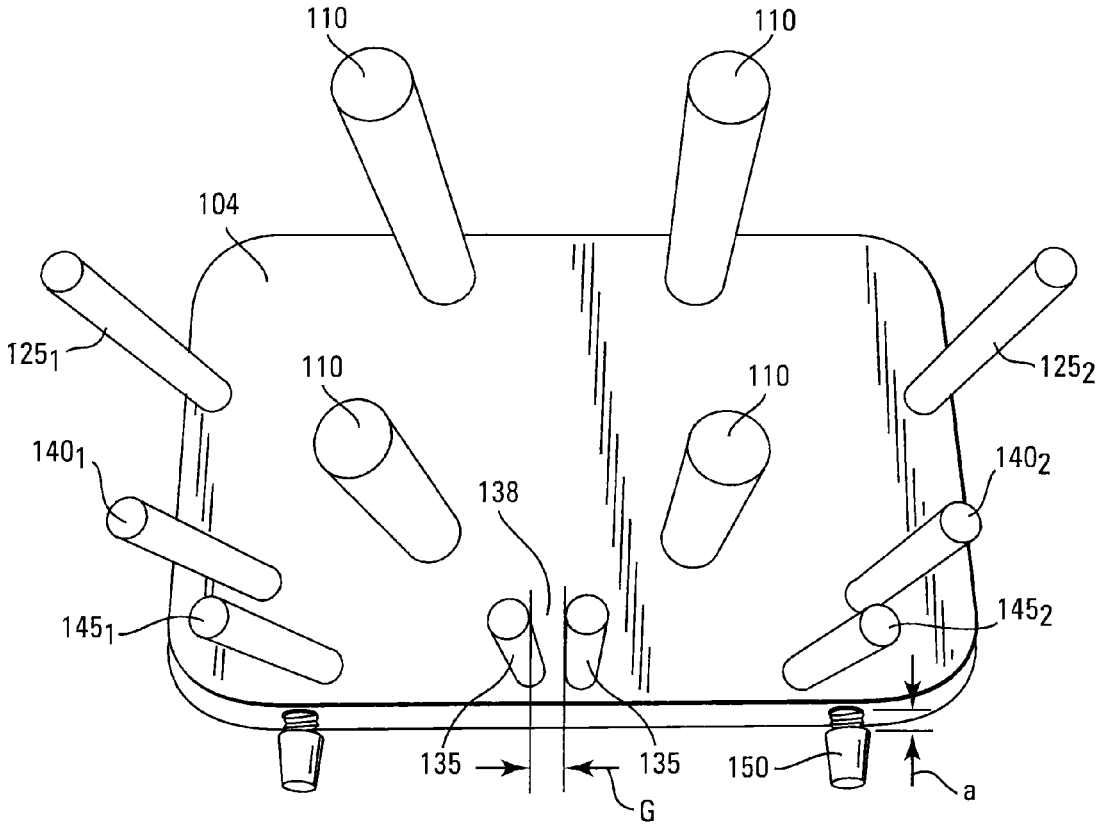
FIG. 4 illustrates an interior of a shredder feeder, according to another embodiment.

FIG. 4 illustrates the interior of shredder feeder 100 with sidewall 106 removed. In addition to posts 110, shredder feeder 100 includes a pair of posts 125 (e.g., that may be called pillars, shafts, dowels, etc.), such as posts $\mathbf{125}_1$ and $\mathbf{125}_2$. Ends of posts 125 may be connected (e.g., attached) to sidewall 104, e.g., by fasteners, such as screws, by gluing, by welding, etc., so that posts 125 are stationary. Posts 125 may be made of steel, iron, aluminum, wood, plastic, etc. For some embodiments, posts 125 may be cylinders, as shown in FIG. 4.

Posts $\mathbf{125}_1$ and $\mathbf{125}_2$ are configured to respectively receive rolls $\mathbf{130}_1$ and $\mathbf{130}_2$ of material, as shown in FIG. 2, so that rolls $\mathbf{130}_1$ and $\mathbf{130}_2$ can respectively rotate about posts $\mathbf{125}_1$ and $\mathbf{125}_2$. As such, posts 125 may be referred to as receiving posts.

The material of rolls 130 may be paper sufficiently heavy to be inserted into a shredder relatively easily and that is unlikely to clog the shredder. That is, the material of rolls 130 is heavier and thicker (e.g., about 0.004 in. thick) than the material of rolls 122 (e.g., about 0.001 in. thick). For example, rolls 130 may be paper rolls of the type commonly used in adding machines, calculators, or point-of-sale devices. Rolls 130 may be of the type often referred to as adding machine paper rolls, teller paper rolls, or the like.

For some embodiments, when shredder feeder 100 is assembled, with sidewall 106 connected (e.g., attached) to posts 110 and posts 110 extending into recesses 112, the ends of posts 125 (opposite the ends connected to sidewall 104) may abut the interior surface 114 of sidewall 106 so that posts 125 span the width W of the interior of shredder feeder 100, as shown in FIG. 1. The width H of a roll 130 may be slightly less (e.g., about ¼ inch less) than the width W to provide clearance between the rolls 130 and sidewalls 104 and 106 so that the rolls 130 can rotate relatively freely when shredder feeder 100 is operating. For one embodiment, the width H of a roll 130 may be about 4.5 inches.

Shredder feeder 100 may also include a pair of guideposts 135 that are separated from each other by a gap G, as shown in FIG. 4. Note that the width of gap G is the distance between parallel lines that are tangent to the cylindrical walls of guideposts 135 for embodiments where guideposts 135 are cylinders, as shown in FIG. 4.

Gap G forms an outlet 138 of shredder feeder 100 between guideposts 135. Outlet 138 is positioned to receive material, e.g., paper, from rolls $\mathbf{130}_1$ and $\mathbf{130}_2$ and material, e.g., ribbon, from a roll 122 so that the material from roll 122 is interposed between the material from roll $\mathbf{130}_1$ and the material from roll $\mathbf{130}_2$, as shown in FIG. 2. Note that material from roll $\mathbf{130}_1$ is interposed between one of the guideposts 135 and the materials from rolls 122, and material from roll $\mathbf{130}_2$ is interposed between the other of the guideposts 135 and the materials from rolls 122. The respective guideposts 135 are positioned to respectively direct the materials from rolls $\mathbf{130}_1$ and $\mathbf{130}_2$ toward the materials from rolls 122 so that the materials from rolls 122 are interposed between the material from roll $\mathbf{130}_1$ and the material from roll $\mathbf{130}_2$ when the materials from rolls 122 pass through outlet 138.

Outlet 138 may receive material directly from a roll 122, e.g., without that material being guided by any intermediate guideposts, as shown in FIG. 2. For example, outlet 138 may receive material directly from each of the rolls 122 (e.g., all four of rolls 122) concurrently so that the material from each of rolls 122 is interposed between the material from roll $\mathbf{130}_1$ and the material from roll $\mathbf{130}_2$, as shown in FIG. 2.

Figure 5:
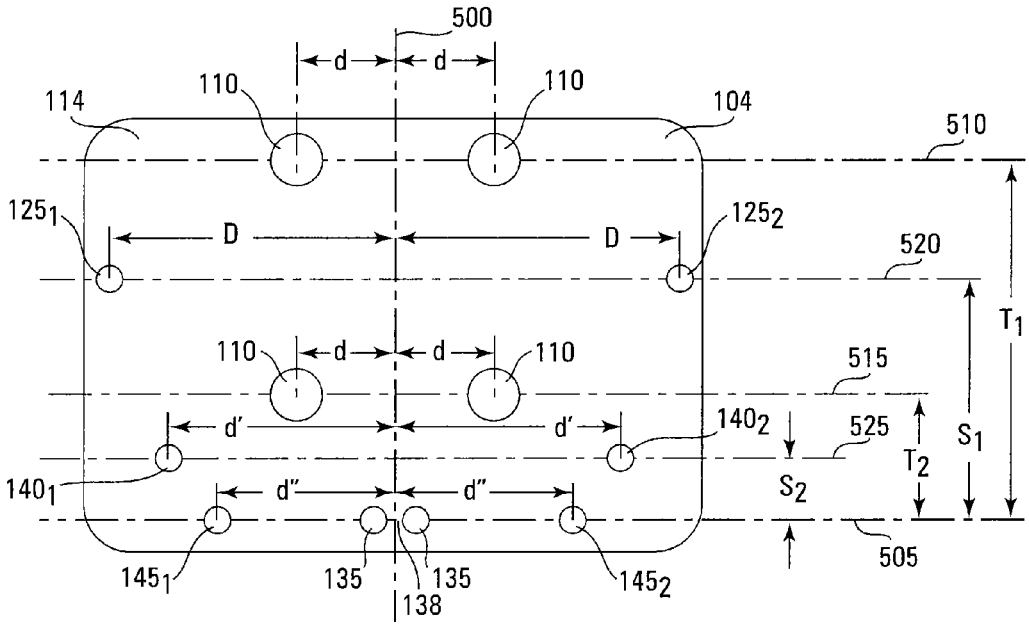
FIG. 5 illustrates a layout of posts of a shredder feeder on an interior surface of a wall of the shredder feeder, according to another embodiment.

FIG. 5 illustrates a layout of the posts on sidewall 104, according to an embodiment. Posts $\mathbf{125}_1$ and $\mathbf{125}_2$ are respectively located on different sides of a central axis 500 that passes through the center of outlet 138. A center of each of posts $\mathbf{125}_1$ and $\mathbf{125}_2$ is located at a lateral distance D from central axis 500, where the lateral distance D is taken along a perpendicular to a central axis 500. A center of each posts 110 is located at a lateral distance d from central axis 500 that may be less than the lateral distance D, where the lateral distance d is taken along a perpendicular to a central axis 500. Although the centers of posts 110 are shown to be at the same or substantially the same lateral distance d from central axis 500, the centers of respective posts 110 may be located at lateral distances from central axis 500 that are different from each other. For some embodiments, shredder feeder 100 may include a single post 110 that may be located on central axis 500 in which case the distance d is zero.

Locating the centers of posts 110 at lateral distances from central axis 500 that are less than the lateral distance from central axis 500 to the centers of posts 125 enables the materials from the respective rolls 122 to pass directly from the respective rolls 122 through outlet 138 and still be interposed between the materials from rolls 130. Locating the centers of posts 110 at lateral distances from central axis 500 that are greater than or equal to the lateral distance from the centers of posts 125 to central axis 500 could require guideposts for directing the materials from rolls 122 to outlet 138 and could increase the area of sidewalls 104 and 106 and thus the overall size of shredder feeder 100.

For some embodiments, guideposts 140 (e.g., guideposts $\mathbf{140}_1$ and $\mathbf{140}_2$) and guideposts 145 (e.g., guideposts $\mathbf{145}_1$ and $\mathbf{145}_2$) are used to direct the materials from rolls 130 to guideposts 135 and thus to outlet 138, as shown in FIG. 2. For example, a center of each of guideposts $\mathbf{140}_1$ and $\mathbf{140}_2$ may be located a lateral distance d' from central axis 500 that may be less than the lateral distance D, where the lateral distance d' is taken along a perpendicular to a central axis 500. A center of each of guideposts $\mathbf{145}_1$ and $\mathbf{145}_2$ may be located a lateral distance d" from central axis 500 that may be less than the lateral distance d', where the lateral distance d" is taken along a perpendicular to a central axis 500.

For some embodiments, central axis 500 forms a central axis of sidewall 104 and thus of shredder feeder 100. For example, central axis 500 may be a symmetry axis and the layout of the posts on either side of central axis 500 is symmetrical about central axis 500, as shown in FIG. 5. That is, central axis 500 may bisect inner surface 114 of sidewall 104 and thus sidewall 104.

For other embodiments, the centers of guideposts 135 and of guideposts 145 may be collinear and lie on a line 505 that is perpendicular to central axis 500, as shown in FIG. 5. The centers of a pair of posts 110 may be collinear and lie on a line 510 that is perpendicular to central axis 500, and the centers of another pair of posts 110 may be collinear and lie on a line 515 that is perpendicular to central axis 500. The centers of posts 125 may be collinear and lie on a line 520 that is perpendicular to central axis 500. The centers of guideposts 140 may be collinear and lie on a line 525 that is perpendicular to central axis 500.

For some embodiments, a distance $S_1$ from line 520, and thus the centers of posts 125, to line 505 is greater than a distance $S_2$ from line 525, and thus the centers of guideposts 140, to line 505, where the distances $S_1$ and $S_2$ are taken along parallels to central axis 500, as shown in FIG. 5. A distance $T_1$ from line 510, and thus the centers of one pair of posts 110, to line 505 is greater than a distance $T_2$ from line 515, and thus the centers of another pair of posts 110, to line 505, where the distances $T_1$ and $T_2$ are taken along parallels to central axis 500, as shown in FIG. 5. Moreover, the distance $T_1$ may be greater than the distance $S_1$, whereas the distance $T_2$ may be less than the distance $S_1$, but greater than the distance $S_2$ Locating guideposts 140 closer to central axis 500 than posts 125, guideposts 145 closer to central axis 500 than guideposts 140, and guideposts 135 closer to central axis 500 than guideposts 145 allows material from each of rolls 130 to be directed inward toward central axis 500, and thus toward the materials from rolls 122, as the material from each of rolls 130 moves toward outlet 138. For example, the materials from rolls $\mathbf{130}_1$ and $\mathbf{130}_2$ move along converging paths toward the materials from rolls 122, as shown in FIG. 2, so that the converging materials from rolls $\mathbf{130}_1$ and $\mathbf{130}_2$ envelops the materials from rolls 122 as they move toward and through outlet 138. Note that guideposts 140, 145, and 135 on either side of central axis 500 respectively define paths for the materials from the respective rolls 130 that envelop the materials from rolls 122, as shown in FIG. 2.

Guideposts $\mathbf{140}_1$ and $\mathbf{140}_2$ are positioned to respectively receive and respectively direct materials from rolls $\mathbf{130}_1$ and $\mathbf{130}_2$ toward opposing sides of the materials from rolls 122. Guideposts $\mathbf{145}_1$ and $\mathbf{145}_2$ are positioned to respectively receive and respectively direct the materials from guideposts $\mathbf{140}_1$ and $\mathbf{140}_2$ further toward the opposing sides of the materials from rolls 122. Guideposts 135 are positioned to respectively receive the materials from guideposts $\mathbf{145}_1$ and $\mathbf{145}_2$ and to respectively direct the materials from guideposts $\mathbf{145}_1$ and $\mathbf{145}_2$ through outlet 138 on the respective opposing sides of the materials from rolls 122.

Guideposts 135, 140, and 145 may be called, for example, pillars, shafts, dowels, etc. and, for example, may be made of steel, iron, aluminum, wood, plastic, etc. Ends of guideposts 135, 140, and 145 may be connected (attached) to sidewall 104, e.g., by fasteners, such as screws, by gluing, by welding, etc., so that they are stationary For some embodiments, guideposts 135, 140, and 145 may be cylinders, as shown in FIG. 4.

When shredder feeder 100 is assembled, with sidewall 106 removably connected (e.g., attached) to posts 110, with posts 110 extending into recesses 112, ends of guideposts 135, 140, and 145 (opposite to the ends connected to sidewall 104) may abut the interior surface 114 of sidewall 106 so that guideposts 135, 140, and 145 span the width W of the interior of shredder feeder 100. For example, guideposts 135, 140, and 145 may extend from sidewall 104 by the same or substantially the same distance as posts 125.

For some embodiments, the diameter of posts 110 may be larger than a diameter of an opening 210 that passes through the center of a roll 130 and that a post 125 passes through when that roll 130 is received over that post 125 (FIG. 2). Making the diameter of posts 110 larger than the diameter of opening 210 prevents a roll 130 from accidently being received on a post 110. The diameters of guideposts 135, 140, and 145 may be the same or substantially the same diameter as posts 125.

For some embodiments, mounting pads 150 (e.g., that may be referred to as feet) protrude from the bottom of shredder feeder 100, as shown in FIG. 1. For example, mounting pads 150 may protrude from a bottom edge of sidewall 106, as shown in FIG. 3, and from a bottom edge of sidewall 104, as shown in FIG. 4. For some embodiments, a distance a between the bottom edges of sidewalls 104 and 106 is adjustable so that the distance between the bottom of shredder feeder 100 and a surface of the shredder can be adjusted for leveling shredder feeder 100. For example, mounting pads 150 may be threadably attached to the bottom edges of sidewalls 104 and 106 so that the distance a can be adjusted by screwing the mounting pads 150 toward or away from the bottom edges of sidewalls 104 and 106. The adjustability of mounting pads 150 enables shredder feeder 100 to be adjusted to fit many different types of shredders, such as top-feed shredders.

Mounting pads 150 may be made from an anti-skid, vibration reducing material, such as rubber, that acts to reduce sliding between the mounting pads and the surface of shredder 102. The anti-skid, vibration reducing material acts to absorb the vibration of the shredder that might otherwise be transmitted to shredder feeder 100, thereby reducing the likelihood of shredder feeder 100 moving relative to the shredder in response to the vibration, thus reducing the likelihood of shredder feeder 100 falling off of the shredder.

To use shredder feeder 100, wall 106 is removed from posts 110, and thus shredder feeder 100, to provide access to the interior (FIG. 4) of shredder feeder 100. One or more rolls 122 are inserted over one or more posts 110 so that each post 110 passes through an opening that passes through a center of the respective roll 122, e.g., as shown in FIG. 2 for four rolls 122. Material from each of rolls 122 and is passed between guideposts 135 and thus through outlet 138.

Rolls $\mathbf{130}_1$ and $\mathbf{130}_2$ are respectively inserted over posts $\mathbf{125}_1$ and $\mathbf{125}_2$ so that posts $\mathbf{125}_1$ and $\mathbf{125}_2$ respectively pass through openings 210 of the respective rolls $\mathbf{130}_1$ and $\mathbf{130}_2$, as shown in FIG. 2. For some embodiments, material from each of rolls 130 is unwrapped from the respective roll 130 and is threaded around guideposts 140 and 145 and is passed between guideposts 135, and thus through outlet 138, on either side of the materials from rolls 122 so that the materials from rolls 122 are interposed between the materials from rolls 130 as the materials from rolls 130 and the materials from rolls 122 are passed through outlet 138.

For example, material from roll $\mathbf{130}_1$ is wrapped around a portion of guidepost $\mathbf{140}_1$ that faces toward the interior of shredder feeder 100, is wrapped around a portion of guidepost $\mathbf{145}_1$ that faces toward an exterior of shredder feeder 100, is wrapped around a portion of the guidepost 135 on one side of the materials from rolls 122, and is passed through outlet 138 between that guidepost 135 and that side of the materials from rolls 122, as shown in FIG. 2. Similarly, material from roll $\mathbf{130}_2$ is wrapped around a portion of guidepost $\mathbf{140}_2$ that faces toward the interior of shredder feeder 100, is wrapped around a portion of guidepost $\mathbf{145}_2$ that faces toward an exterior of shredder feeder 100, is wrapped around a portion of the guidepost 135 on an opposing side of the materials from rolls 122, and is passed through outlet 138 between that guidepost 135 and the opposing side of the materials from rolls 122, as shown in FIG. 2.

Although rolls 122 are described as being loaded into shredder feeder 100 before rolls 130, rolls 130 may be inserted into shredder feeder 100 and the materials therefrom may be threaded, as described above, before the rolls 122 are loaded. Then, rolls 122 are inserted, as described above, and the materials therefrom are threaded between the materials from rolls 130 while the materials from rolls 130 pass between guideposts 135 and thus outlet 138.

Figure 6:
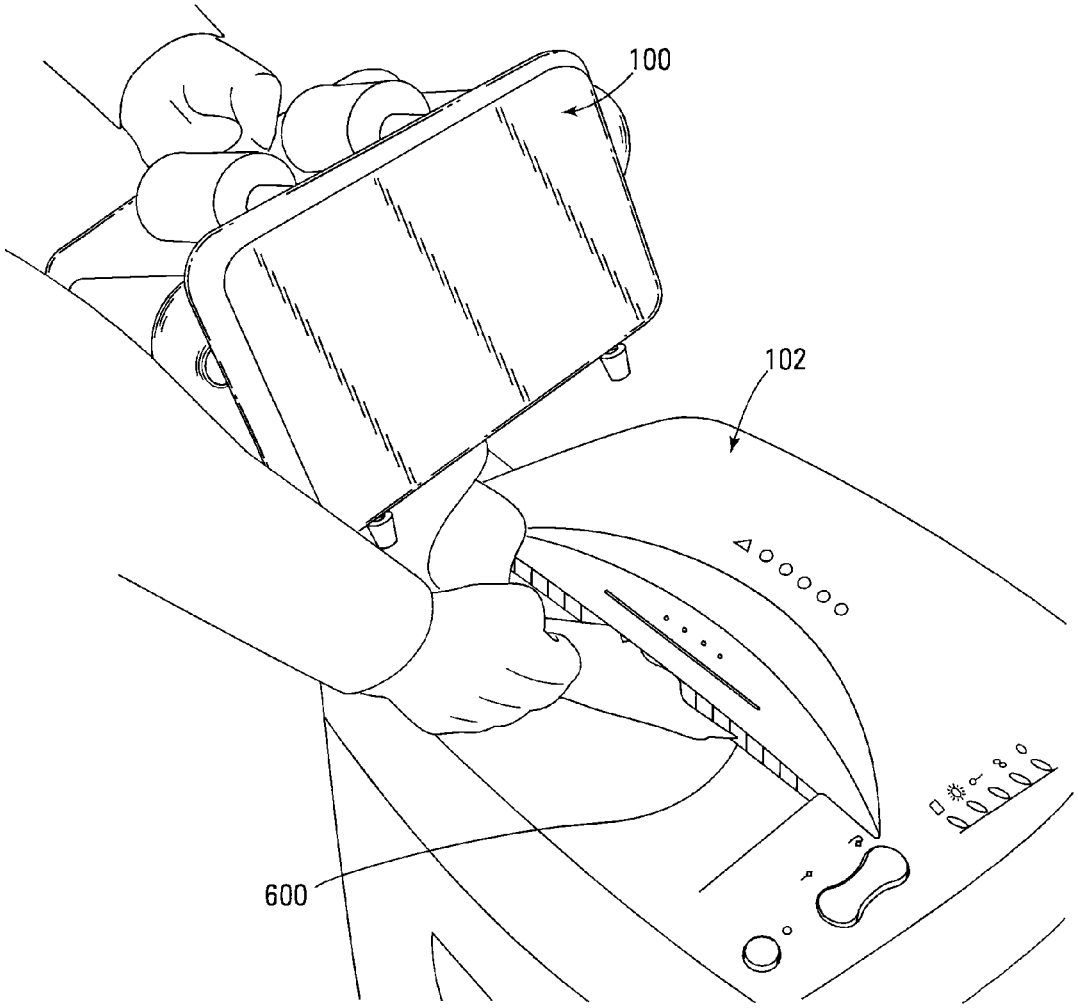
FIG. 6 illustrates materials from a shredder feeder with another material from the shredder feeder interposed therebetween being loaded into a shredder.

After loading shredder feeder 100 with rolls 122 and 130 and threading the materials therefrom through outlet 138, as described above, sidewall 106 is replaced. The materials from rolls 130, with the material from one or more rolls 122 interposed therebetween, that extends from the exterior of the assembled shredder feeder 100 is then fed into an inlet 600 of shredder 102, as shown in FIG. 6. Shredder feeder 100 is then positioned on shredder 102, as shown in FIG. 1. The materials from rolls 130, with the material from one or more rolls 122 interposed therebetween, is sufficiently stiff to be inserted into shredder 102 and reduces the likelihood of buckling that is associated with trying to insert the material from a roll 122, such as ribbon, without the materials from rolls 130.

During operation, shredder 102 draws in the materials from rolls 130, with the material from one or more rolls 122 interposed therebetween, and shreds it. That is, the materials from rolls 130 and the material from one or more rolls 122 are shredded concurrently or substantially concurrently. The materials from rolls 130, with the material from one or more rolls 122 interposed therebetween, reduces the likelihood of the material from the one or more rolls 122 of becoming lodged in the strippers of a shredder, such as shredder 102, and/or sticking to the cutting cylinders of the shredder, and thus reduces the likelihood of the shredder becoming clogged or seizing.

In addition, the material from rolls 130, such as paper, may sufficiently opaque, for some embodiments, to prevent light from passing therethrough and reaching a light detector that activates the shredder when the light is not received by the light detector. This reduces the likelihood of the light detector sensing light passing through the material, such as translucent or transparent transfer ribbon, from one or more rolls 122, and thus preventing activation of the shredder, in that the material from the one or more rolls 122 is interposed between the material from rolls 130.

As the materials from rolls 130, with the material from one or more rolls 122 interposed therebetween, are drawn into shredder 102, shredder feeder 100 continuously interposes the material from one or more rolls 122 between the materials from rolls 130. Drawing in the materials from rolls 130, with the material from one or more rolls 122 interposed therebetween, causes rolls 130 and rolls 122 to rotate concurrently respectively around posts 125 and 110. In other words, rolls 130 and rolls 122 rotate in response to shredder 102 concurrently drawing in the materials from rolls 130, and the material from one or more rolls 122 interposed between the materials from rolls 130, from outlet 138. As rolls $\mathbf{130}_1$ and $\mathbf{130}_2$ and one or more rolls 122 rotate, the materials from rolls $\mathbf{130}_1$ and $\mathbf{130}_2$ and one or more rolls 122 are concurrently directed through posts 135 and through outlet 138, with the materials from rolls $\mathbf{130}_1$ and $\mathbf{130}_2$ located on opposing sides of the materials from one or more rolls 122.

For example, as $\mathbf{130}_1$ and $\mathbf{130}_2$ and rolls 122 rotate, the materials from rolls $\mathbf{130}_1$ and $\mathbf{130}_2$ are respectively received at guideposts $\mathbf{140}_1$ and $\mathbf{140}_2$. Guideposts $\mathbf{140}_1$ and $\mathbf{140}_2$ respectively direct the materials from rolls $\mathbf{130}_1$ and $\mathbf{130}_2$ received thereat to guideposts $\mathbf{145}_1$ and $\mathbf{145}_2$. The materials from rolls $\mathbf{130}_1$ and $\mathbf{130}_2$ are respectively received at guideposts $\mathbf{145}_1$ and $\mathbf{145}_2$, and guideposts $\mathbf{145}_1$ and $\mathbf{145}_2$ respectively direct the materials from rolls $\mathbf{130}_1$ and $\mathbf{130}_2$ to the guideposts 135 on either side of the material from one or more rolls 122.

As indicated above, the width of a roll of indent ribbon may be much less than the width of a roll of conventional transfer ribbon, such as thermal and topping ribbon. As such, for some embodiments, a spacer 722 may be used to space a roll 720 of indent ribbon away from sidewall 104 and/or sidewall 106, as shown in the cross-sectional view of FIG. 7. Each spacer 722 has an outer diameter that is greater than a diameter of an opening 724 that passes through the center of roll 720. The diameter of an opening 726 that passes through the center of each spacer 722 may be slightly larger than the diameter of a post 110 to provide clearance between the respective spacer 722 and the post 110 to facilitate insertion of the respective spacer 722 over the post 110 and removal of the respective spacer 722 from the post 110. The diameter of the opening 724 that passes through the center of roll 720 may be slightly larger than the diameter of the post 110 to provide clearance between roll 720 and the post 110 so that roll 720 can rotate relatively freely about the post 110. The diameter of the opening 726 that passes through the center of each spacer 722 may be about the same as or smaller than the diameter of the opening 724 that passes through the center of roll 720.

To space roll 720 from walls 104 and 106, as shown in FIG. 7, spacer $\mathbf{722}_1$ is inserted over a post 110 so that the post 110 passes through the opening 726 that passes through the center of spacer $\mathbf{722}_1$. Then, a roll 720 is inserted over the post 110 so that the post 110 passes through the opening 724 that passes through the center of roll 720. Subsequently, spacer $\mathbf{722}_2$ is inserted over the post 110 so that the post 110 passes through the opening 726 that passes through the center of spacer $\mathbf{722}_2$. Then, the post 110 is received in a recess 112 in sidewall 106 and is brought into direct physical contact with a magnet 120.

As shown in FIG. 7, spacer $\mathbf{722}_1$ is interposed between sidewall 104 and roll 720; roll 720 is interposed between spacers $\mathbf{722}_1$ and $\mathbf{722}_2$; and spacer $\mathbf{722}_2$ is interposed between roll 720 and sidewall 106. Note that the respective lengths $M_1$ and $M_2$ of spacers $\mathbf{722}_1$ and $\mathbf{722}_2$ may be sized to provide clearance on either side of roll 720 so as to reduce friction between the respective spacers 722 and roll 720 so that roll 720 can rotate relatively freely about the post 110.

CONCLUSION

Although specific embodiments have been illustrated and described herein it is manifestly intended that the scope of the claimed subject matter be limited only by the following claims and equivalents thereof.

What is claimed is:

1. A method of forming a shredder, comprising:

connecting a first receiving post to a first wall, the first receiving post receiving a roll of first material such that the roll of first material is rotatable about the first receiving post;

connecting second and third receiving posts to the first wall, the second and third receiving posts respectively receiving first and second rolls of second material such that the first and second rolls of second material are respectively rotatable about the second and third receiving posts;

connecting a pair of guideposts to the first wall to form an outlet between the the guideposts; and removably connecting a second wall to the first receiving post;

wherein the respective guideposts of the pair of guideposts are positioned to respectively direct the second material from the first and second rolls of second material toward the first material from the roll of first material so that the first material is interposed between the second material from the first roll of second material and the second material from the second roll of second material when the first material and the second materials from the first and second rolls of second material pass concurrently through the outlet.

2. The method of claim 1, further comprising, before removably connecting the second wall to the first receiving post, attaching a magnet to the second wall, wherein the second wall is removably connected to the first receiving post by an attractive force from the magnet.

3. The method of claim 1, wherein the second and third receiving posts are respectively located on different sides of a central axis that passes through a center of the outlet, wherein the second and third receiving posts are each located at a distance from the central axis that is greater than a distance from the central axis at which the first receiving post is located.

4. The method of claim 3, wherein the pair of guideposts is a first pair of guideposts, and further comprising, before removably connecting the second wall to the first receiving post, connecting a second pair of guideposts to the first wall, a first guideposts of the second pair of guideposts located on the same sides of the central axis as the second receiving posts, and a first guidepost of the first pair of guideposts, a second guidepost of the second pair of guideposts located on a same side of the central axis as the third receiving post and a second guidepost of the first pair of guideposts, the first guidepost of the second pair of guideposts that is less than a distance from the second receiving post to the first guidepost of the first pair of guideposts, the first guidepost of the second pair of guideposts located at a distance from the central axis that is less than the distance from the central axis at which the second receiving post is located that is greater than a distance from the central axis at which the first guidepost of the first pair of guideposts is located, and that is greater than the distance from the central axis at which the first receiving post is located, the second guidepost of the second pair of guideposts located at a distance from the second guidepost of the first pair of guideposts that is less than a distance from the third receiving post to the second guidepost of the first pair of guideposts, the second guidepost of the second pair of guideposts located at a distance from the central axis that is less than the distance from the central axis at which the third receiving post is located, that is greater than a distance from the central axis at which the second guidepost of the first pair of guideposts is located, and that is greater than the distance from the central axis at which the first receiving post is located.

5. The method of claim 4, further comprising, before removably connecting the second wall to the first receiving post, connecting a third pair of guideposts to the first wall, a first guidepost of the third pair of guideposts located on a same side of the central axis as the first guideposts of the first and second pairs of guideposts, a second guidepost of the third pair of guideposts located on a same side of the central axis as the second guideposts of the first and second pairs of guideposts, the first guidepost of the third pair of guideposts located at a distance from the first guidepost of the first pair of guideposts that is less than the distance from the first guidepost of the first pair of guideposts at which the first guidepost of the second pair of guideposts is located, the first guidepost of the third pair of guideposts located at a distance from the central axis that less than the distance from the central axis at which the first guidepost of the second pair of guideposts is located, that is greater than the distance from the central axis at which the first guidepost of the first pair of guideposts is located, and that is greater than the distance from the central axis at which the first receiving post is located, the second guidepost of the third pair of guideposts located at a distance from the second guidepost of the first pair of guideposts that is less than the distance from the second guidepost of the first pair of guideposts at which the second guidepost of the second pair of guideposts is located, the second guidepost of the third pair of guideposts located at a distance from the central axis that less than the distance from the central axis at which the second guidepost of the second pair of guideposts is located, that is greater than the distance from the central axis at which the second guidepost of the first pair of guideposts is located, and that is greater than the distance from the central axis at which the first receiving post is located.

6. The method of claim 1, wherein the roll of first material is a first roll of the first material, and further comprising:

connecting one or more additional first receiving posts to the first wall, each additional first receiving post configured to receive a second roll of the first material, wherein the respective guideposts of the pair of guideposts are positioned to respectively direct the second material from the first and second rolls of second material toward the first material from the first roll of the first material and each of the second rolls of the first material so that the first material from the first roll of the first material and each of the second rolls of the first material is interposed between the second material from the first roll of second material and the second material from the second roll of second material when the first material from the first roll of the first material and each of the second rolls of the first material and the second material from the first and second rolls of second material pass concurrently through the outlet;

attaching a plurality of magnets to the second wall that correspond on a one-to-one basis with the first receiving posts; and removably magnetically connecting each of the first receiving posts to a corresponding one of the magnets.

* * * * *